US008022171B2

(12) United States Patent
Goossens et al.

(10) Patent No.: US 8,022,171 B2
(45) Date of Patent: Sep. 20, 2011

(54) PROCESS FOR MAKING A MONOFILAMENT-LIKE PRODUCT

(75) Inventors: Francois Jean Valentine Goossens, Hamme (BE); Johannes Eliazbeth Adrianus Kriele, Putte (NL); Joseph Arnold Paul Maria Simmelink, Sittard (NL); Christiaan Henri Peter Dirks, Dilsen (BE)

(73) Assignee: DSM IP Assets B.V., Heerlen (NL)

( * ) Notice: Subject to any disclaimer, the term of this patent is extended or adjusted under 35 U.S.C. 154(b) by 480 days.

(21) Appl. No.: 11/665,014

(22) PCT Filed: Oct. 14, 2005

(86) PCT No.: PCT/EP2005/011173

§ 371 (c)(1), (2), (4) Date: Dec. 29, 2008

(87) PCT Pub. No.: WO2006/040191

PCT Pub. Date: Apr. 20, 2006

(65) Prior Publication Data

US 2009/0115099 A1 May 7, 2009

(30) Foreign Application Priority Data

Oct. 14, 2004 (EP) ..... 04077832

(51) Int. Cl.
*B29C 55/00* (2006.01)
*C08F 110/02* (2006.01)
*D02G 3/02* (2006.01)

(52) U.S. Cl. ..... 528/502 B; 526/348.1; 264/291

(58) Field of Classification Search ..... 526/348.1; 528/502 B; 264/291
See application file for complete search history.

(56) References Cited

U.S. PATENT DOCUMENTS

| | | | | |
|---|---|---|---|---|
| 6,148,597 | A * | 11/2000 | Cook | 57/287 |
| 6,183,834 | B1 | 2/2001 | van der Loo | |
| 6,448,359 | B1 | 9/2002 | Kavesh | |
| 7,584,596 | B2 | 9/2009 | Nakanishi | |

FOREIGN PATENT DOCUMENTS

| | | | |
|---|---|---|---|
| JP | 2007-517992 | | 7/2001 |
| JP | 2002-339184 | | 11/2001 |
| JP | 2003-528994 | | 9/2003 |
| JP | 2005-76149 | | 3/2005 |
| JP | 2007-522351 | | 8/2007 |
| WO | 00/24811 | | 5/2000 |
| WO | 01/73173 | | 10/2001 |
| WO | WO 2004/033774 | A1 * | 4/2004 |
| WO | WO 2005/066400 | A1 | 7/2005 |
| WO | WO 2005/066401 | A1 | 7/2005 |

OTHER PUBLICATIONS

International Search Report mailed Jan. 27, 2006 in PCT/EP2005/011173.
Written Opinion mailed Jan. 27, 2006 in PCT/EP2005/011173.

* cited by examiner

*Primary Examiner* — Fred M Teskin
(74) *Attorney, Agent, or Firm* — Nixon & Vanderhye P.C.

(57) ABSTRACT

The invention relates to a process for making a monofilament-like product from a precursor containing a multitude of continuous polyolefin filaments, comprising exposing the precursor to a temperature within the melting point range of the polyolefin for a time sufficient to at least partly fuse adjacent fibers and simultaneously stretching the precursor at a draw ratio of at least 2.8. With the process according to the invention a monofilament-like product can be made that shows improved tensile properties; making it very suitable for application as e.g. fishing line.

5 Claims, No Drawings

PROCESS FOR MAKING A MONOFILAMENT-LIKE PRODUCT

This application is the US national phase of international application PCT/EP2005/011173 filed 14 Oct. 2005 which designated the U.S. and claims benefit of EP 04077832.6, dated 14 Oct. 2004, the entire content of which is hereby incorporated by reference.

FIELD

The invention relates to a process for making a monofilament-like product from a precursor containing a multitude of continuous polyolefin filaments, comprising exposing the precursor to a temperature within the melting point range of the polyolefin for a time sufficient to at least partly fuse adjacent fibres while simultaneously stretching the precursor.

BACKGROUND AND SUMMARY

Such a process is known from EP 0740002 B1. In this patent publication a process for making a fishing-line from yarns of filamentous materials is described, wherein a line made from braided, twisted, or twisted and plied yarns of gel spun polyolefin filaments is exposed to a temperature within the melting point range of said polyolefin for a time sufficient to at least partially fuse adjacent filaments while stretching said line at a stretching ratio within the range from 1.01 to 2.5, preferably from 1.35 to about 2.2. It is indicated that applying such stretch ratio to the precursor during the heat exposure is needed in order to keep the filaments under elongational tension, so as to prevent decrease of the strength of the product as a result of thermal molecular relaxation processes. The yarns applied in this process are continuous multi-filament yarns, more specifically such yarns made by so-called gel spinning of ultra-high molar mass polyethylene (UHMWPE), for example yarns commercially available under the trademarks Spectra® or Dyneema®. The monofilament-like products thus obtained in EP 0740002 B1 typically show a tenacity of from 13 to 32 g/d, and an elongation at break of from 1.9 to 3.3%.

Fishing lines are generally monofilaments made from synthetic polymers, having a round, firm structure that allows convenient handling for bait casting, spinning, and spin casting. Such monofilament lines generally have a stiff nature and smooth surface, which combine to reduce drag during the cast and enable longer casts while providing better release from fishing reels. Braided lines containing a multitude of filaments are less suited for fishing lines, because they have a tendency to fray at the end of the line, may entrap water, present an outer surface that is vulnerable to snags and entanglement, and have an opaque appearance that is too visible below water. The process known from EP 0740002 B1 allows making monofilament-like fishing lines from braided or twisted lines made from polyolefin multi-filaments yarns, which lines have specific advantages over braided lines. The performance of such fused lines also compares favourable with that of a conventional monofilament made from e.g. polyamide by melt extrusion in view of is higher tensile strength (or tenacity) and stiffness; but its elongation at break is significantly lower (about 2-3% versus 10-20%). On the one hand, low elongation and high modulus are advantageous for a fishing line, because it allows a fisherman to feel even an initial bite of a fish on a lure. On the other hand, a low elongation results in relatively low total energy absorption upon instant heavy loading, as upon hooking a fish, and may thus result in premature breaking. A line of low elongation, or low elasticity, also more readily injures biting fish. Therefore, it is desirable to have a monofilament-like product made from a precursor containing a multitude of continuous polyolefin filaments that combines higher elongation with comparable stiffness and strength as the known lines, especially the strength of a line containing a knot (knot strength).

There is thus a constant need for fishing lines offering improved performance, especially improved tensile properties. It is therefore an object of the present invention to provide a process for making a monofilament-like product with enhanced tensile properties.

This object is achieved according to the invention with a process for making a monofilament-like product from a precursor containing a multitude of continuous polyolefin filaments, comprising exposing the precursor to a temperature within the melting point range of the polyolefin for a time sufficient to at least partly fuse adjacent fibres while simultaneously stretching the precursor at a draw ratio of at least 2.7.

With the process according to the invention a monofilament-like product can be made from e.g. a plied or braided construction of polyolefin yarns, which product shows favourable tensile properties, such as a higher elongation at break, as measured in a tensile test as specified in ASTM D885M, more specifically by using a nominal gauge length of the fibre of 500 mm, a crosshead speed of 50%/min and Instron 2714 clamps. The monofilament-like product obtained by the process according to the invention typically shows an elongation at break of at least 4.0%, which makes it very suitable for use as fishing-line, as surgical suture and the like. The monofilament-like product obtained by the process according to the invention also shows high knot strength and knot strength efficiency. The mono-filament-like product obtained further has a pleasant touch or feel and can be easily handled and knotted. Another advantage of the process according to the invention is that it can be applied with high efficiency to twisted or air-entangled multifilament yarns, whereas in the known process braided precursors were applied for best results. The process according to the invention also offers more flexibility, in that a range of products with varying linear density (titer) can be made from one precursor. This means a simplification of the overall production process, and thus a more cost effective production.

It is true that applying a higher draw ratio during thermal fusion of a line containing polyolefin fibres is also suggested in WO 2004/033774 A1, but the process described therein is applied to a precursor containing spun yarn made from short staple fibres, which precursor has a completely different construction than a precursor containing continuous filaments. In addition, in the examples in WO 2004/033774 A1 only a draw ratio of at most 1.8 is disclosed; and elongation at break of a product made tends to decrease with increasing draw ratio.

It is further known that a relatively high draw ratio can be applied in the (post-)stretching steps forming part of the so-called gel spinning process of polyolefin into high-strength fibres; for example in EP 0205960 post-stretching is indicated to improve creep-resistance of multifilament UHMWPE yarn. Said publication, however, is silent on thermally fusing multifilament yarn into a monofilament-like product.

With the process according to the invention a monofilament-like product is made from a precursor containing a multitude of continuous polyolefin filaments. A monofilament-like product is understood to be a product that has an appearance and feel more resembling that of a monofilament than that of multi-filament yarn or cord, but which actually is made from a multitude of continuous filaments that typically have a diameter of less than about 50, often less than 30 micrometer. The monofilament-like product may have a diameter that varies within a wide range, e.g. from about 0.05 up to several millimeters (or more general products of titer from e.g. 10 up to several thousands dtex). A precursor is herein understood to be an article of indefinite length containing a multitude of continuous polyolefin filaments, for example one or more multifilament yarns of titre 50-2000 dtex, and is used as feed or starting material in the process according to the invention. A suitable precursor can be in the form of for example a braided cord, a plied and twisted yarn, cord or rope comprising a number of strands containing polyolefin filaments, but also a single-strand yarn. The precursor contains predominantly polyolefin filaments, i.e. 50 or more mass % of the total amount of filaments, preferably it contains at least 70, 80, 90 mass % of polyolefin filaments, or even substantially consists of only such filaments. This results in a line with high mechanical performance.

DETAILED DESCRIPTION

The process according to the invention comprises the step of exposing the precursor to a temperature within the melting point range of the polyolefin for a time sufficient to at least partly fuse adjacent fibres. The conditions of this fusion step are chosen such, that the temperature and time of exposure are sufficient to soften the polyolefin filaments at their surfaces and to allow them to fuse at least partly, especially at the outer surface of the precursor line. The melting point range of the polyolefin is the temperature range between the peak melting point of a non-oriented polyolefin and the peak melting point of a constrained highly-oriented polyolefin fibre, as determined by DSC analysis using a scan-rate of 20° C./min. For UHMWPE filaments, typically showing a melting point range of 138-162° C., the temperature is preferably within the range from about 150° C. up to about 157° C. Residence times during which the precursor is exposed to the fusion temperature may vary within a broad range, but are typically within the range from about 5 seconds to about 1500 seconds. Although higher temperatures tend to enhance the fusion process, care should be taken not to apply too high a temperature as this may cause loss in strength of the product, resulting from e.g. partial melting or other molecular relaxation effects within the inner parts of the filaments. Suitable means for performing this process include ovens with accurate temperature control and drawing means; which is known to the skilled person, as well as alternative means for performing the process according to the invention.

During the fusion process, the appearance of the precursor changes from an initial, opaque appearance, for example of white colour, into a translucent, milky, or even substantially transparent surface appearance of the product, depending on the degree of fusion and type of precursor material. The light transmission of the product increases with increased degree of fusion between fibres. Such an increase in translucency or light transmission is a definite advantage for application as underwater fishing-lines. The natural white colour may also have been adjusted by addition of colorants.

For a monofilament-like product showing low end fraying and little surface pilling it suffices that an outer surface layer of the line is at least partly fused, as seen by increase in translucency. A higher degree of fusion, e.g. also binding filaments in more inner parts of a precursor or strand, however, is preferred for making a product with a higher bending stiffness and higher transparancy, that is with more monofilament-like characteristics. Preferably, an outer fused surface layer that is substantially non-porous is made. Such product shows a smooth surface with enhanced abrasion resistance, and little tendency to delamination effects like pilling. The fused surface layer may enclose a core that still has mainly filamentous character, providing more flexibility to the product. The degree of fusion can be adjusted for example by varying exposure temperature and/or time of exposure in the process according to the invention.

The degree of fusion can be determined on the product obtained, for example by visual evaluation, e.g. with the naked aye or by using an optical or electron microscope; or by measuring mechanical properties like strength or stiffness. Another possibility is to determine the amount and rate of absorption of a coloured liquid, e.g. from a marker, as described in EP 0740002 B1. The degree of fusion can also be derived from a test, wherein the loaded product is abraded over a metal rod and the number of movements is determined after which the monofilament-like product disintegrates into its constituting filaments.

The process according to the invention includes simultaneously stretching the precursor at a draw ratio, also called stretch ratio, of at least 2.7. It is known from EP 0740002 B1 that applying a draw ratio of from 1.01 to 2.5 to the precursor during the heat exposure is needed to keep the filaments under tension and so to prevent that the strength of the product decreases as a result of thermal molecular relaxation processes. The inventors now found that applying a higher draw ratio is possible, especially of 2.7 or higher, and can improve tensile properties. Above a certain draw ratio the property enhancing effect levels off, or properties may even decrease as result of partly damaging or breaking of fibres. In addition, the higher the draw ratio, the lower the titre of the resulting product. The maximum draw ratio is thus dependent on the type of precursor and its filaments, and is generally at most about 10. Preferably, the draw ratio applied in the process according to the invention is from 2.8 to 10, from 3.0 to 8, more preferably from 3.5 to 7, or even from 4 to 6 to arrive at optimum tensile properties of the product.

In the process according to the invention the precursor contains continuous polyolefin filaments, which can be chosen from various polyolefins. Particularly suitable polyolefins are homo- and copolymers of ethylene or propylene. Polyethylene or polypropylene copolymers contain small amounts, generally less than 5 mol %, of one or more other monomers, in particular other alpha-olefins like propylene resp. ethylene, and butene, pentene, 4-methylpentene or octane, or vinyl- or acrylic monomers like vinylacetate or (meth)acrylic acid. Good results are achieved if linear polyethylene (PE) is chosen as polyolefin. Linear polyethylene is here understood to be polyethylene with less than one side chain per 100 carbon atoms, and preferably less than one side chain per 300 carbon atoms; a side chain or branch usually containing at least 10 carbon atoms. The linear polyethylene preferably contains less than 1 mol % of comonomers, such as alkenes, more preferably less than 0.5 or even less than 0.3 mol %. The advantage of using such homopolymer polyethylene is that a higher draw ratio can be applied, resulting in better tensile properties of the product.

Preferably, the polyolefin fibre, in particular the polyethylene fibre, has an intrinsic viscosity (IV) of more than 5 dl/g. Because of their long molecule chains, polyolefin fibres with such an IV have very good mechanical properties, such as a high tensile strength, modulus, and energy absorption at break. The IV is determined according to method PTC-179 (Hercules Inc. Rev. Apr. 29, 1982) at 135° C. in decalin, the dissolution time being 16 hours, with DBPC as anti-oxidant in an amount of 2 g/l solution, and the viscosity at different concentrations is extrapolated to zero concentration. Intrinsic viscosity is a measure for molar mass (also called molecular weight) that can more easily be determined than actual molar mass parameters like $M_n$ and $M_w$. There are several empirical relations between IV and $M_w$, for example $M_w=5.37\times10^4$ $[IV]^{1.37}$ (see EP 0504954 A1), but such relation is highly dependent on molar mass distribution. Polyethylene of such high viscosity is often called ultra-high molar mass polyethylene, abbreviated UHMWPE. UHMWPE filament yarn can be prepared by spinning of a solution of UHMWPE into a gel fibre and drawing the fibre before, during and/or after partial or complete removal of the solvent; that is via a so-called gel-spinning process. Gel spinning of UHMWPE is well known to the person skilled in the art; and described in numerous publications, including EP 0205960 A, EP 0213208 A1, U.S. Pat. No. 4,413,110, GB 2042414 A, EP 0200547 B1, EP 0472114 B1, WO 01/73173 A1, and Advanced Fiber Spinning Technology, Ed. T. Nakajima, Woodhead Publ. Ltd (1994), ISBN 1-855-73182-7, and references cited therein. Gel spinning is understood to include at least the steps of spinning at least one filament from a solution of ultra-high molecular weight polyethylene in a spin solvent; cooling the filament obtained to form a gel filament; removing at least partly the spin solvent from the gel filament; and drawing the filament in at least one drawing step before, during or after removing spin solvent. Suitable spin solvents include for example paraffins, mineral oil, kerosene or decalin. Spin solvent can be removed by evaporation, extraction, or by a combination of evaporation and extraction routes.

Preferably, UHMWPE filaments having an IV in the range 5-25 dl/g, more preferably in the range 6-20, or even 7-15 dl/g, are chosen. Although in general a higher IV or molar mass of UHMWPE results in higher mechanical strength, application of UHMWPE filaments of relatively low IV in the present process is found to result in a product with better resistance to abrasion; that is the so-called pilling effect is reduced (less filamentous material visible on the surface of the product during its use as fishing line).

In addition to the polyolefin polymer the filaments may contain small amounts (e.g. less than 5 mass %) of additives that are customary for such fibres, such as anti-oxidants, spin-finishes, thermal stabilizers, colorants, etc.

In the process according to the invention preferably polyolefin, especially UHMWPE, filaments are applied that have not been stretched to the maximum extent during their production, because this allows fusing and stretching with a draw ratio of at least 2.7 without the risk of overstretching filaments, i.e. without filament breakage occurring to a significant extent. In this way a product with high tensile properties is obtained. In addition, presence of broken filaments in the product may increase pilling behaviour.

The process according to the invention can be performed with a precursor of various constructions, for example of a braided construction, or a plied (or folded) and twisted construction. Preferably, a plied and twisted precursor containing twisted or air-entangled filaments, or a twisted or air-entangled multifilament yarn is applied. A certain twist level is applied to give the strand sufficient consistency during handling, and during fusing and drawing. Such consistency can be given to a multifilament yarn applied as strand in the precursor by twisting or by air-entangling. Applying precursors wherein the filaments are twisted or air-entangled strands, rather than braided constructions has the advantage that the precursor, and monofilament-like product can be made with less production steps and more cost-effectively; and that the product obtained still shows favourable performance; especially surprisingly good resistance to failure during abrasion tests.

The fusing efficiency of the process according to the invention can be further improved by mechanically compressing the precursor during fusing. It has been found that if a certain force is applied around the surface of the precursor a more homogeneous fusing of the filaments occurs, at least in the outer layer of the precursor. This results in a smoother surface appearance, and also improves abrasion resistance of the monofilament-like product, for example a reduced tendency to pilling during use as fishing line.

In a preferred embodiment of the process according to the invention the precursor is compressed during fusing by passing the precursor over at least one guiding member having a surface comprising a groove or slit, in such way that the whole surface of the precursor contacts the member inside a groove at least one time, and pressure is exerted around substantially the whole precursor. Preferably, the groove is V-shaped with a top opening of such dimension that allows easy entry of a filamentous precursor that may have been spread to some extent, and with the bottom of the groove having such dimension and geometry to define the desired dimension and shape of the monofilament-like product. The guiding member may be a static cylindrical bar, but is preferably a freely rotating wheel or roller, or a driven roller. The force exerted on the line can for example be adjusted by changing the tension in the line and/or by adjusting the diameter of a cylindrical member. The skilled person can find desirable combinations by some experimentation. An additional advantage of this embodiment is, that by choosing the geometry of the groove, the cross-sectional geometry of the monofilament-like product can be controlled, and be kept be constant over great length of the product. For example, by applying a V-shaped groove with a rounded bottom, a cylindrical or oval product can be made; but also other geometries are possible. The dimensioning of a groove may also be different for subsequent members, for example the radius of a rounded bottom may stepwise decrease so as to further compress the line. It is found that 2 or more members give more consistent results, more preferably at least 3, 4, 5 or even more members are used. Preferably, the surface of the member is also controlled at a temperature within the melting point range of the polyolefin, so as to better control the degree of fusing and the geometry of the product, for example by placing the members inside the oven used for drawing and fusing. In a special embodiment, the member is of slightly higher temperature, for example 1 or 2 degrees, than the temperature setting of (for example the oven applied) drawing and fusing. The advantage hereof is that fusing is even more efficient and that a well-defined fused outer skin can be made.

In another embodiment of the process according to the invention the precursor is mechanically compressed during fusing by guiding and pulling the precursor through an opening having a surface area at its smallest point of at most equal to the total cross-sectional area of the precursor, e.g. the sum of all filament cross-sections, thus pressing the filaments in the precursor together. Examples of suitable openings include a conical die, a ring or a set of rings with decreasing size of openings. The above-indicated preferences for geometry, temperature setting etc. of grooved guiding members apply likewise. Pulling a precursor through an opening, however, could present some difficulties in production regarding starting-up, changing desired product dimensions etc. Some of these drawbacks may be reduced by using an opening that is formed by at least two movable complementary parts, and only forming the enclosed opening when the drawing process has started running, taking care that not part of the precursor filaments are trapped upon bringing the parts together.

The monofilament-like product obtained by above process comprising compressing during fusion, shows a substantially non-porous surface layer, as seen by optical or electron microscopy, and has cross-sectional geometry and area that show little variation over its length. Depending on the applied conditions, inner filaments may or may not have been fused.

Preferably, the product obtained with the process according to the invention is cooled while keeping it under tension. This has the advantage that the orientation in the product retained/obtained during fusing and stretching, on both level of filaments and on molecular level, is retained better. Such tension can result from, for example, winding the product into packages subsequent to preceding steps of the process.

The process according to the invention can further comprise a preceding step of pre-treating the precursor, or one or more of the strands therein, in order to enhance inter filament bonding during the fusion step. Such pre-treatment step may include coating the precursor with a component or a composition; scouring the precursor, that is washing-off surface components like spin finishes etc.; or applying a high-voltage plasma or corona treatment, or a combination thereof. Preferably, the precursor comprises UHMWPE fibres that are substantially free from spin finish, meaning no spin finish was applied or spin finish is removed in a pre-treating step. This has the advantage that abrasion resistance of the monofilament-like product is further increased, and that little pilling is observed during use as fishing line.

In another embodiment the precursor is pre-treated by applying; e.g. by dipping or wetting, an effective amount of a mineral oil (e.g. heat transfer grade mineral oil with an average molar mass of about 250-700), vegetable oil (e.g. coconut oil), or a, preferably non-volatile, solvent for polyolefin; like paraffin. This pre-treatment step may be performed at ambient conditions, or at elevated temperature up to below the melting temperature range of the polyolefin fibre, and may even coincide with stretching and fusing. The advantage of such step is that the efficiency of the fusing process is further enhanced, that is a higher degree of fusion at the same temperature, or a similar degree at slightly lower temperature can be attained. The oil or solvent may further comprise other additives, like colorants or stabilisers. The amount of oil or solvent can vary widely, for example from 0.1 to 25 mass %, based on the UHMWPE fibres. For medical applications preferably no or only very low amounts are applied; for applications like fishing lines preferred amounts are 2-20, more preferably 5-15 mass %.

In a further embodiment, pre-treating comprises applying a coating composition to the precursor, which composition may be a solution or dispersion of a polymer that enhances fibre to fibre bonding during exposure to higher temperature at the fusing step, or otherwise improves performance. In a preferred embodiment, the precursor is coated with a polyurethane composition, like a dispersion of film-forming polyurethane. Such a composition may further comprise components that contribute to improving the abrasion- or cut-resistance of the monofilament-like product. Examples of components that improve cut-resistant are small particulate particles of high surface hardness, like mineral particles, ceramic particles, glass, metals and the like. The coating composition may further comprise other additives, like colorants or stabilisers.

The process according to the invention can further comprise a step wherein a coating composition is applied to the product after fusing and drawing to form a coating layer. Such coating composition may comprise a typical spin finish to allow easier handling and processing of the product in subsequent operations; a compound or composition to control adhesion during subsequent making of composite articles comprising the product; or a binder composition that further enhances integrity and strength of the product. Typical examples of the latter include polyurethane or polyolefin-based, like ethylene-acrylic copolymers, binder compositions. The coating composition can be in the form of a solution or dispersion. Such a composition may further comprise components that further improve the abrasion- or cut-resistance of the monofilament-like product. Examples of components that improve cut-resistant are small particulate particles of high surface hardness, like various mineral or ceramic particles. The coating composition may further comprise other additives, like colorants, stabilisers, etc.

The invention also relates to a monofilament-like product comprising at least partly fused polyolefin filaments, which product is obtainable by the process according to the invention. The monofilament-like product according to the invention combines high tensile strength and modulus, with relatively high elongation at break; can be easily knotted, and the knotted product shows high knot strength. The monofilament-like product also shows good resistance to abrasion.

The invention specifically relates to a novel monofilament-like product comprising at least partly fused UHMWPE filaments, having an elongation at break of at least 4.0%, which is higher than known monofilament-like products comprising at least partly fused UHMWPE filaments. Preferably, the elongation at break of such product is at least 4.2%, more preferably at least 4.5%. Such product has a tensile strength of at least 15 cN/dtex, preferably at least 20, 25, 30 or even 35 cN/dtex.

The monofilament-like product obtainable by the process according to the invention has a linear density, also referred to as titre, which may vary within wide limits, e.g. from 10 to 15000 dtex. Generally, the product has a titre of from 30 to 2500 dtex. The lower titre products are suitable for use as surgical sutures and the like. In view of applications like fishing or kite lines, or protective garments and clothing, the titre is preferably from 100 to 2000 dtex, even more preferably from 200 to 1600 dtex.

The invention further relates to the use of the monofilament-like product according to invention for making various semi-finished products and end-use products, like fishing lines; kite lines; surgical sutures; various fabrics, cords and ropes, composite yarns, and their use in for example cut-resistant articles.

The invention also concerns semi-finished products and end-use products comprising the monofilament-like product according to the invention.

The invention will now be further illustrated by the following experiments.

Comparative Experiment A

As precursor (feed) material a twisted 195-filament UHMWPE yarn of 918 dtex, with twist level of 320 clockwise turns/m, and having a tensile strength of 15 cN/dtex, a tensile modulus of 174 cN/dtex and elongation at break of 4.6% was applied. This yarn was obtained by a known gel-spinning process, wherein the gel filaments were not drawn to the maximum extent.

Stretching and fusing of this precursor was done following the procedure described in EP 0740002 B1, wherein the precursor passes two ovens kept at constant temperatures of 153° and 154° C., respectively. By controlling the speed of driven rollers before, between and after the ovens draw ratios were set to 1.36 and 1.4, resulting in an overall draw ratio of 1.9. Before entering the ovens the precursor was passed through a bath of liquid paraffin as pre-treatment step, and excess oil was wiped off by passing between non-woven fabrics. The paraffin content was calculated to be about 12 mass % by determining the mass increase upon this step. The obtained line showed monofilament-like character, and had more translucent appearance than the starting yarn.

The tensile strength (or strength), the tensile modulus (also modulus) and elongation at break (eab) of the partly fused line (and starting yarn) were determined as specified in ASTM D885M, using a nominal gauge length of the fibre of 500 mm, a crosshead speed of 50%/min and Instron 2714 clamps. For calculation of the strength, the tensile forces measured are divided by the titre, as determined by weighing 10 meters (or another length) of fibre. Elongation is the measured elongation at break, expressed in % of the original length after clamping the specimen. Knot strength is determined by measuring the strength of a specimen wherein a Palomar-knot is made. The Palomar-knot is a general-purpose connection recommended for joining a fishing line to a swivel, a snap or a hook. The doubled end of the specimen is passed through the eye of a hook and a simple overhand knot is made. The hook is then passed through the loop and the knot is tightened. Results of testing are compiled in Table 1.

Examples 1 and 2

These experiments were performed analogously to Comp. Exp. A, be it that an overall draw ratio of 2.7 or 3.7 was applied, while keeping the draw rate about the same. Paraffin content was about 11 and about 10 mass %, respectively. Results of further testing are compiled in Table 1. A higher draw ratio is found to result in a monofilament-like product with higher strength, knot strength and knot strength retention; and higher elongation at break than the sample made with draw ratio 1.9. Abrasion resistance, especially pilling behaviour, was similar for all three samples.

TABLE 1

| | (unit) | Comp. Exp. A | Example 1 | Example 2 |
|---|---|---|---|---|
| Applied draw ratio | | 1.9 | 2.7 | 3.7 |
| Tensile strength | (cN/dtex) | 24.8 | 25.3 | 35.2 |
| Elongation at break | (%) | 3.2 | 4.0 | 4.1 |
| Knot strength | (cN/dtex) | 15.2 | 17.5 | 23.5 |
| Knot strength retention | % | 61 | 69 | 67 |

The invention claimed is:

1. A process for making a monofilament-like product comprising the steps of:

(a) providing a precursor consisting of a multitude of twisted or air-entangled continuous filaments, wherein the precursor contains predominantly continuous polyolefin filaments, and (b) exposing the precursor to a temperature within the melting point range of the polyolefin for a time sufficient to at least partly fuse adjacent fibres while simultaneously stretching the precursor at a draw ratio of at least 2.7.

2. The process according to claim 1, wherein the draw ratio is from 2.8 to 10.

3. The process according to claim 1, wherein the polyolefin is an ultra-high molar mass polyethylene.

4. The process according to claim 3, wherein the polyolefin is a linear polyethylene that contains less than 1 mol % of comonomers.

5. The process according to claim 3, wherein the polyethylene has an intrinsic viscosity, as determined on solutions in decalin at 135° C., in the range 5-25 dl/g.

* * * * *